US006741207B1

(12) United States Patent
Allison et al.

(10) Patent No.: US 6,741,207 B1
(45) Date of Patent: May 25, 2004

(54) MULTI-BIT PHASE SHIFTERS USING MEM RF SWITCHES

(75) Inventors: Robert C. Allison, Rancho Palos Verdes, CA (US); Clifton Quan, Arcadia, CA (US); Brian M. Pierce, Moreno Valley, CA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 09/607,604

(22) Filed: Jun. 30, 2000

(51) Int. Cl.[7] ..... H01Q 3/38; H01P 1/18
(52) U.S. Cl. ..... 342/371; 342/375; 333/164
(58) Field of Search ..... 333/164; 342/371, 342/375

(56) References Cited

U.S. PATENT DOCUMENTS 4,751,453 A * 6/1988 Foti ..... 333/164 X
4,764,740 A * 8/1988 Meyer ..... 333/164
5,379,007 A * 1/1995 Nakahara ..... 333/156
5,757,319 A * 5/1998 Loo et al. ..... 342/375
6,046,659 A 4/2000 Loo et al. ..... 333/262
6,281,838 B1 * 8/2001 Hong ..... 342/371

* cited by examiner

*Primary Examiner*—Ben T. Lee
(74) *Attorney, Agent, or Firm*—Leonard A. Alkov; Glenn H. Lenzen, Jr.

(57) ABSTRACT

An RF phase shifter circuit includes first and second RF ports, and a switch circuit comprising a plurality of micro-electro-mechanical ("MEM") switches responsive to control signals. The switch circuit is arranged to select one of a plurality of discrete phase shift values introduced by the phase shifter circuit to RF signals passed between the first and second RF ports. The circuits can be connected to provide a single-pole-multiple-throw (SPMT) or multiple-pole-multiple-throw (MPMT) switch function. The phase shifter circuits can be used in an electronically scanned array including a linear array of radiating elements, with an array of phase shifters coupled to the radiating elements. An RF manifold including a plurality of phase shifter ports is respectively coupled to a corresponding phase shifter RF port and an RF port. A beam steering controller provides phase shift control signals to the phase shifters to control the phase shift setting of the array of the phase shifters. The SPMT and MPMT switch circuits can be employed in other applications, including switchable attenuators, switchable filter banks, switchable time delay lines, switch matrices and transmit/receive RF switches.

12 Claims, 12 Drawing Sheets

MULTI-BIT PHASE SHIFTERS USING MEM RF SWITCHES

This invention was made with Government support under Contract No. F33615-99-2-1473 awarded by the Department of the Air Force. The Government has certain rights in this invention.

TECHNICAL FIELD OF THE INVENTION

This invention relates to techniques for introducing phase shifts in RF applications, and more particularly to phase shifting techniques using micro-electro-mechanical switches ("MEMS").

BACKGROUND OF THE INVENTION

Exemplary applications for this invention include space-based radar systems, situational awareness radars, and weather radars. Space based radar systems will use electronically scan antennas (ESAs) including hundreds of thousands of radiating elements. For each radiating element, there is a phase shifter, e.g. 3 to 5 bits, that, collectively in an array, control the direction of the antenna beam and its sidelobe properties. For ESAs using hundreds of thousands of phase shifters, these circuits must be low cost, be extremely light weight (including package and installation), consume little if no DC power and have low RF losses (say, less than 1 dB). For space sensor applications (radar and communications) these requirements exceed what is provided by known state of the art devices.

Current state of the art devices used for RF phase shifter applications include ferrites, PIN diodes and FET switch devices. These devices are relatively heavier, consume more DC power and more expensive than devices fabricated in accordance with the present invention. The implementation of PIN diodes and FET switches into RF phase shifter circuits is further complicated by the need of additional DC bias circuitry along the RF path. The DC biasing circuit needed by PIN diodes and FET switches limits the phase shifter frequency performance and increase RF losses. Populating the entire ESA with presently available T/R modules is prohibited by cost and power consumption. In short, the weight cost and performance of the currently available devices fall short of what is needed for ESAs requiring electrically large apertures and/or large numbers of radiating elements, e.g. greater than 5000 elements.

Other applications for the invention include switchable attenuators, switchable filter banks, switchable time delay lines, switch matrices and transmit/receive RF switches.

SUMMARY OF THE INVENTION

In accordance with one aspect of the invention, an electronically scanned array is described. The array includes a linear array of radiating elements, with an array of phase shifters coupled to the radiating elements. An RF manifold including a plurality of phase shifter ports is respectively coupled to a corresponding phase shifter RF port and an RF port. A beam steering controller provides phase shift control signals to the phase shifters to control the phase shift setting of the array of the phase shifters. The phase shifters each include a plurality micro-electro-mechanical ("MEM") switches responsive to the control signals to select one of a discrete number of phase shift settings for the respective phase shifter.

In accordance with another aspect of the invention, an RF phase shifter circuit includes first and second RF ports, and a switch circuit comprising a plurality of micro-electro-mechanical ("MEM") switches responsive to control signals, said switch circuit arranged to select one of a plurality of discrete phase shift values introduced by the phase shifter circuit to RF signals passed between the first and second RF ports, the circuits connected to provide a single-pole-multiple-throw (SPMT) or multiple-pole-multiple-throw (MPMT) switch function.

BRIEF DESCRIPTION OF THE DRAWINGS

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENTS

Figure 1:
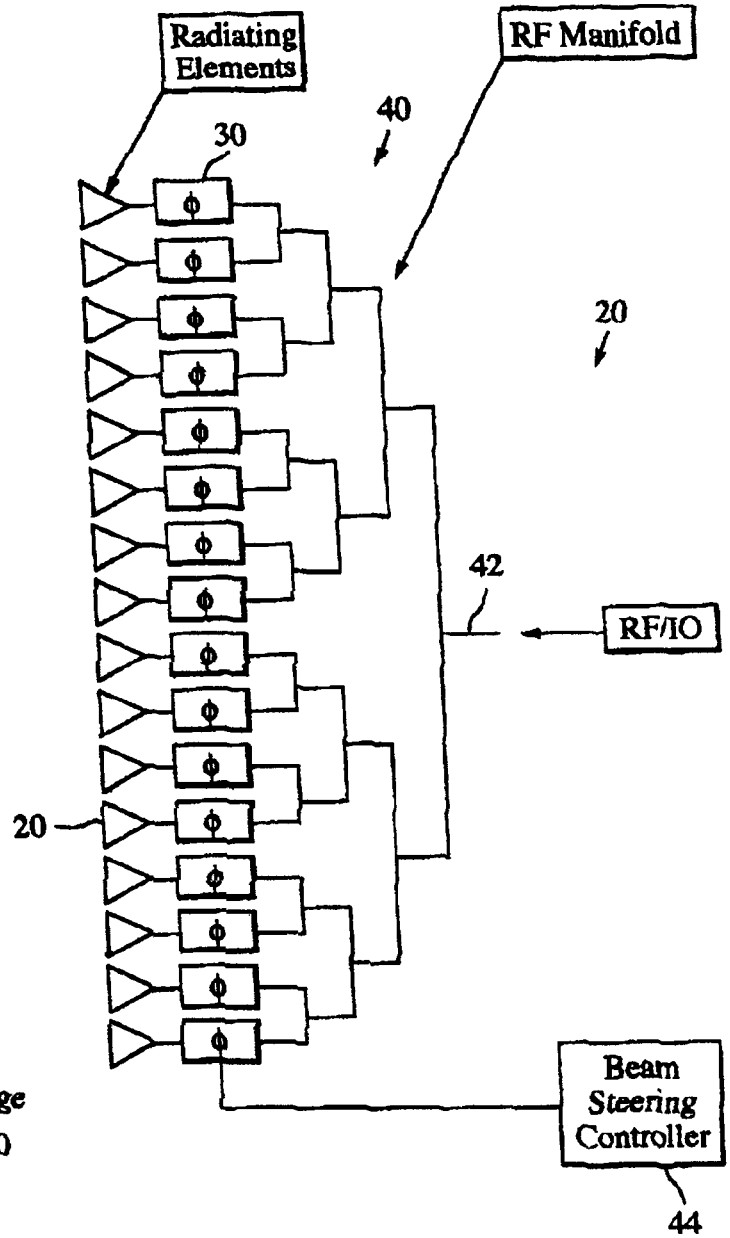
FIG. 1 is a simplified schematic diagram of an ESA antenna architecture employing MEMS phase shifters in accordance with an aspect of the invention.

Space-based radar systems have a need for ESA performance for synthetic aperture radar mapping, ground moving target indication and airborne moving target indication. At the same time, the cost and weight that come with a large ESA fully populated with Transmit/Receive (T/R) modules is undesirable. FIG. 1 is a simplified schematic diagram of an ESA 20 in accordance with an aspect of the invention, which addresses the problems of ESA cost, weight and power consumption by using an ESA antenna architecture in combination with MEMS phase shifters. The ESA in this embodiment is a one dimensional linear array of radiating elements 20, each of which is connected to a corresponding MEMS phase shifter 30 comprising a linear array of phase shifters. The use of a linear array of the phase shifters reduces the number of transmit/receive (T/R) modules for the ESA. An RF manifold 40 combines the phase shifter RF ports into an ESA RF port. A beam steering controller 44 provides control signals to the phase shifters 30 which controls the respective phase settings of the phase shifters 30 to achieve the desired ESA beam direction.

The array 20 can include a single T/R module connected at the ESA RF port 42, or multiple T/R modules connected at junctions in the RF manifold. The array 20 in this embodiment is capable of reciprocal (transmit or receive) operation. Moreover, a plurality of the linear arrays 20 can be assembled together to provide a two dimensional array.

The MEMS ESA provides new capabilities in such applications as space-based radar and communication systems and X-band commercial aircraft situation awareness radar. Commercial automotive radar applications including adaptive cruise control, collision avoidance/warning and automated brake application will also benefit from the MEMS ESA because this technology is scaleable to higher operational frequencies.

Figure 2:
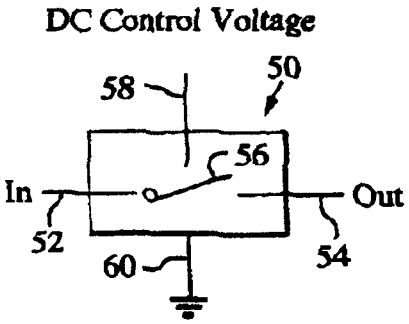
FIG. 2 is a simplified electrical circuit of an RF MEM switch.

In the following exemplary embodiments, the MEMS phase shifters 30 employ MEM metal-metal contact switches. U.S. Pat. No. 6,046,659, the entire contents of which are incorporated herein by this reference, describes a MEM switch suitable for the purpose. FIG. 2 is a simplified electrical circuit of an RF MEM switch 50. The switch has RF ports 52, 54, and an armature 56 which can be closed to complete the circuit between the RF ports by application of a DC control voltage between line 58 and the ground 60. The switch 50 can be fabricated with an area on the order of 0.0025 square inch, and to require less than one microwatt in DC control power, at a voltage range of 20 V to 40 V.

Figure 3A:
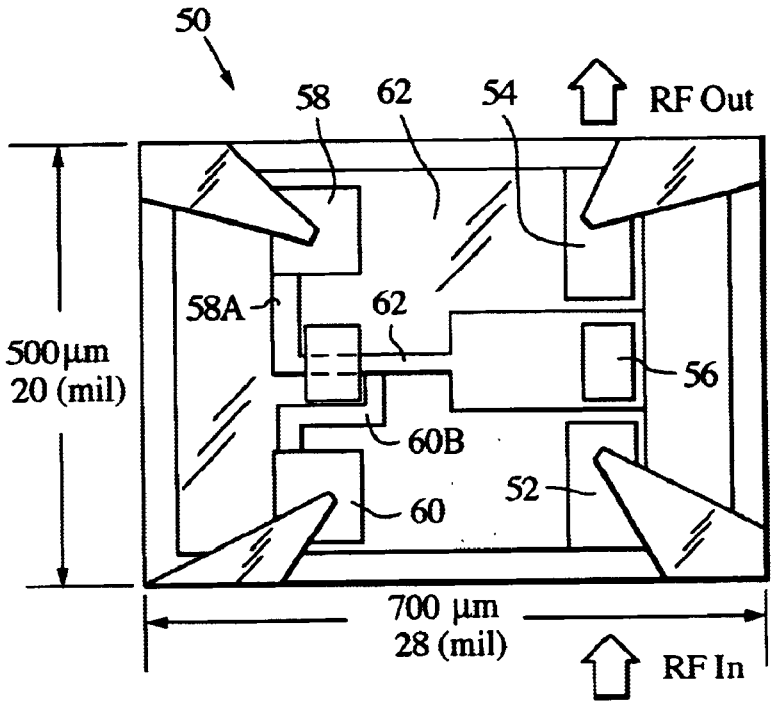
FIGS. 3A–3B are diagrammatic side views of an exemplary form of the RF MEM switch in the respective switch open (isolation) and switch closed (signal transmission) states.
Figure 3B:
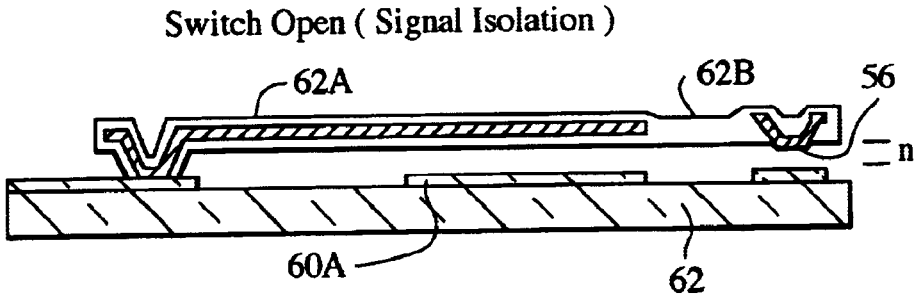
Figure 3C:
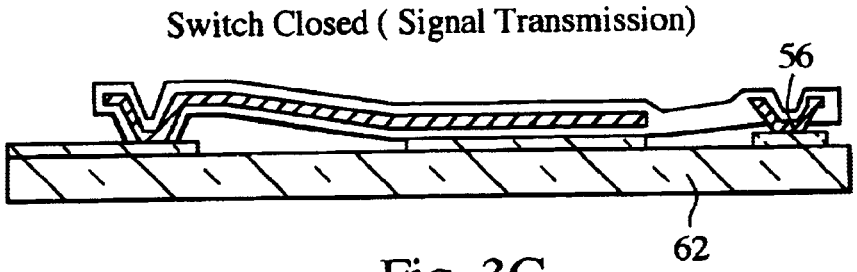
FIG. 3C is a diagrammatic top view.

Unlike PIN diodes, metal-metal contact RF MEM switches do not need bias circuitry on the RF path. FIGS. 3A–3B are diagrammatic side views of an exemplary form of the RF MEM switch in the respective switch open (isolation) and switch closed (signal transmission) states; FIG. 3C is a diagrammatic top view. The drawings are not to scale. The switch 50 is fabricated on a substrate 62, e.g. GaAs, on which are formed conductive contact layers 52, 54, anchor contact 64 and bias electrode 60, conductive pads 58, 60, bias electrode 60A, and traces 58A and 60B.

A cantilevered beam 62 fabricated as a silicon nitride/gold/silicon nitride tri-layer has an anchor end attached to contact 58A; the opposite RF contact end is cantilevered over the RF contacts 52, 54, and has the armature 56 disposed transversely to the extent of the beam 58. The armature 56 is fabricated as a gold layer in the beam, and is exposed such that when the switch is in the closed state (FIG. 3B), the armature is brought into bridging contact between the RF contacts 52, 54. The beam 62 includes a conductive gold layer 62A extending from the contact strip 58A and over the bias electrode 60A. The area 62B between the armature 56 and the bias electrode is not electrically conductive, and is fabricated only of silicon nitride. Thus a DC voltage can be set up between contacts 58, 60, to provide a voltage between electrode 60A and the layer 62A in the beam, and is isolated from the armature 56.

When the switch is open, the armature is above the RF contacts 52, 54 by a separation distance h, which in this exemplary embodiment is 2 microns. When a DC voltage is established across the bias electrodes, the beam 62 is deflected downwardly by the electrostatic force, bringing the armature into bridging contact between the RF contacts and closing the switch. One very important aspect of the switch is the physical separation/isolation between the DC bias electrodes and the RF contacts by insulating layers, e.g. silicon nitride layers. These insulating layers isolate the DC actuation voltage from the RF line and also enhance the structural integrity and reliability of the cantilever beam 62 used in the switch. This feature simplifies the control circuit, and maintains the high RF isolation of the switch in the open state.

The metal-metal contact RF MEM switches have low insertion loss and high isolation as functions of frequency. The metal-metal contact switch is a series switch with a low capacitance in the open state that is inversely proportional to frequency. The isolation at X-band for the metal-metal contact switch is in the range of −35 to −40 dB. Also the isolation performance of the metal-metal contact switch improves with decreasing frequency making it suitable for point to point radio applications.

Figure 4A:
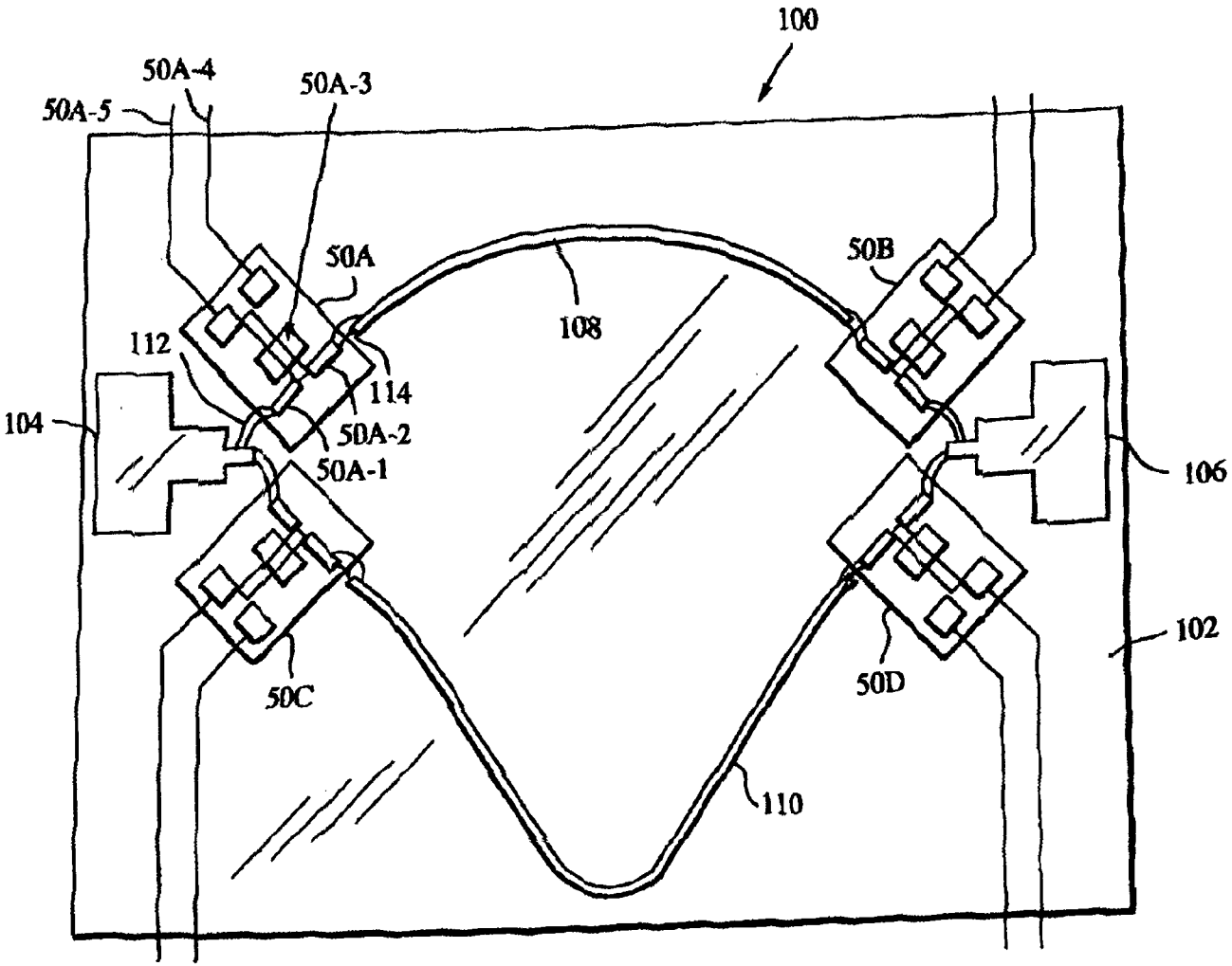
FIG. 4A illustrates a schematic of a 1 bit, hybrid switched line phase shift section employing a MEM switch.

In accordance with an aspect of the invention, a new class of switched line phase shifter configurations using RF MEM switches is provided. FIG. 4A illustrates a schematic of a 1 bit, hybrid switched line phase shift section 100, or "unit cell." Like conventional PIN diode and FET switched phase shifters, the phase shifter is realized by switching in different lengths of transmission lines (FIG. 4). Unlike PIN diode and FET switches, DC bias used to actuate the metal-metal RF MEMS switches is not coupled to the RF transmission line. This embodiment of the unit cell is fabricated on a low-loss substrate 102, e.g. alumina. A conductor pattern is fabricated on the top surface of the substrate to define the RF ports 104, 106, and the reference transmission line path 108 and phase shift transmission line path 110. The MEM switch 50A is connected by wire bond connections 112, 114 between the port 104 and one end of the reference path 108. Elements of the switch 50A are diagrammatically shown in FIG. 4, including the RF ports indicated as 50A-1 and 50A-2 to which the wire bond connections are made. The cantilever beam is shown as element 50A-3. The DC bias connections are made at 50A-4 and 50A-5. The other end of the reference path 108 is connected though switch 50B to the RF port 106.

MEM switch 50C is connected via wire bonds between the port 104 and an end of the phase shift path 110. Switch 50D is connected between the other end of the phase shift path and the port 106. It can be seen that by appropriate control of the MEM switches, either (or both) paths 108, 110 can be connected between the ports 104, 106.

Figure 4B:
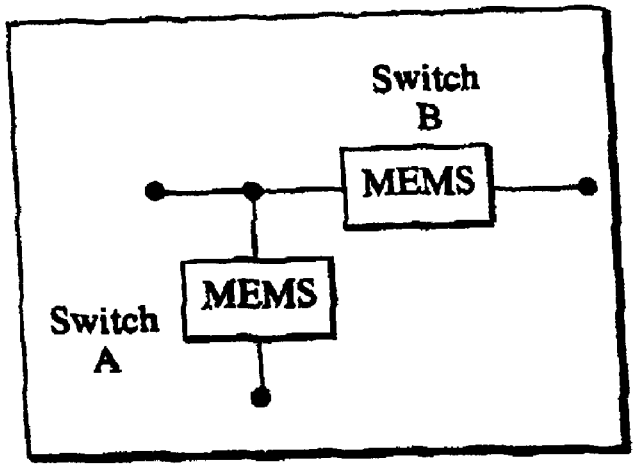
FIGS. 4B–4D illustrate the switch configuration in further detail.
Figure 4C:
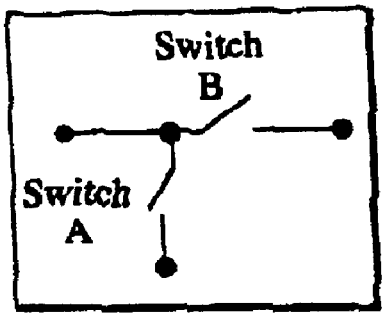
Figure 4D:
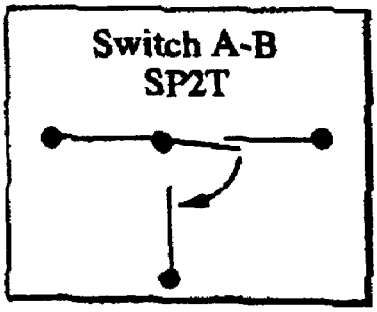

FIG. 4B illustrates an arrangement of MEMS devices used for the switched line phase shifter of FIG. 4, with MEMS device A representing MEM switch 50A, and MEMS device B representing MEM switch 50C of FIG. 4A. The equivalent circuit for this arrangement is provided by SPST switches A, B, (FIG. 4C). The arrangement of MEMS A and B provides two states, a first state with switch A open and switch B closed, and a second state with switch A closed and switch B open. FIG. 4D shows the equivalent SP2T switch providing these two states.

Figure 5:
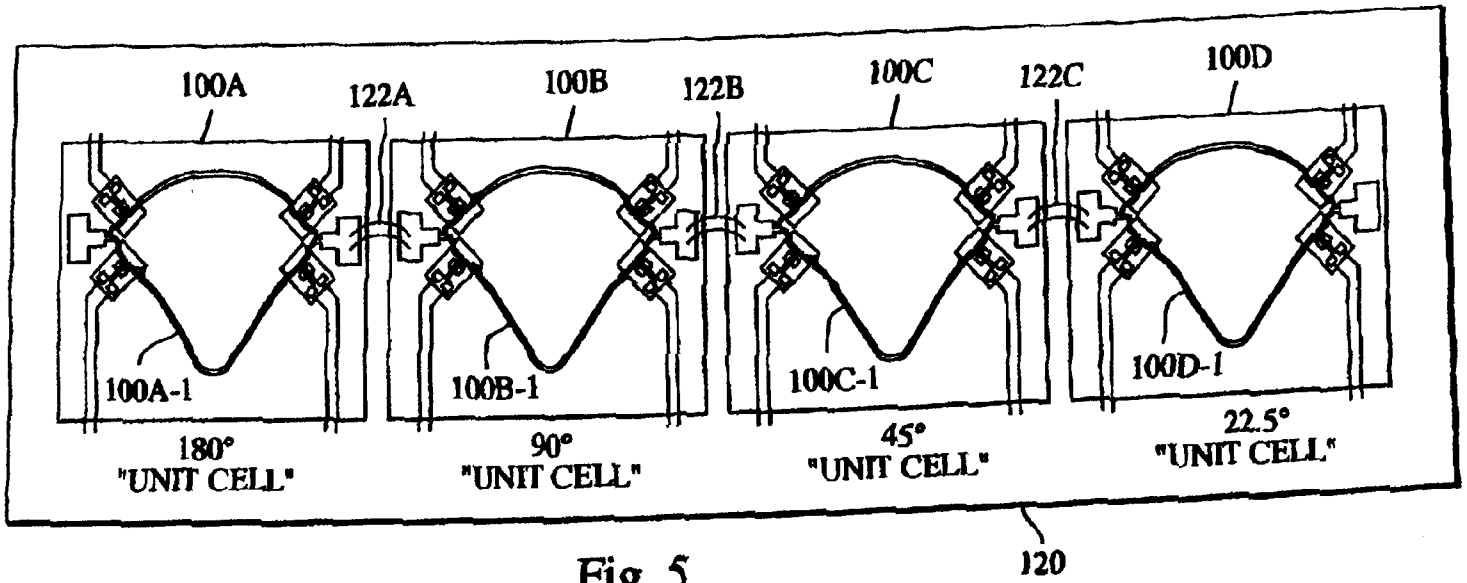
FIG. 5 is a schematic diagram of a 4-bit phase shifter formed by four of the single bit phase shift sections of FIG. 4.

The basic single bit RF MEMS switched line phase shifter 100 shown in FIG. 4A uses a SP2T junction. Four of these single bit unit cell can be combined to form a 4-bit phase shifter 120 as shown in FIG. 5. Thus, single bit unit cells 100A, 100B, 100C and 100D, each with a different phase shift transmission path length, are connected in series to form a four bit shifter. For this embodiment, the unit cells are mounted on a substrate 124, e.g. alumina, in close series proximity so that wire bond connections 122A, 122B and 122C can be used to make RF connections between adjacent RF ports of the unit cells. Unit cell 100A has the length of phase shift path 100A-1 selected to provide 180° phase shift at an operating wavelength. The respective phase shift paths 100B-1, 100C-1 and 100D-1 are selected to provide respective phase shifts of 90°, 45° and 22.5°.

Further advancement of the single bit RF MEMS switched line phase shifter is achieved by using a SP3T junction to realize an additional transmission line path while maintaining the same foot print of the basic single bit circuit. While the basic single bit switched line phase shifter circuit or unit cell 100 (FIG. 4A) has only one phase shift state, a MEMS circuit using a SP3T junction has two phase shift states. This RF MEM switched line phase shifter section is combined to realize the equivalent "3.5" bit and "4.5" bit phase shifter circuits shown in FIGS. 6A and 6B. The "3.5" bit phase shifter circuit 140 has nine phase states, i.e. approximately 3.5 bits, and the loss through the circuit is largely determined by the cumulative loss of MEM switches 142A, 142B, 144A, 144B. Each of these m[]q switches is a SP3T switch. The circuit 140 includes two sections or cells 142, 144. Cell 142 includes MEM switches 142A, 142B, a reference signal path 142C, and two phase shift paths 142D, 142E of unequal length. Section 144 includes MEM switches 144A, 144B, reference signal path 144C, and two phase shift paths 144D, 144E of unequal length. The circuit RF ports 146, 148 are connected to one side of the respective switches 142A, 144B. Switches 142A, 142B provide the capability of selecting the reference path 142C, phase shift path 142D or phase shift path 142E. Switches 144A, 144B provide the capability of selecting the reference path 144C, phase shift path 144D or phase shift path 144E. A connection path 145 connecting switches 142B and 144A.

Figure 6B:
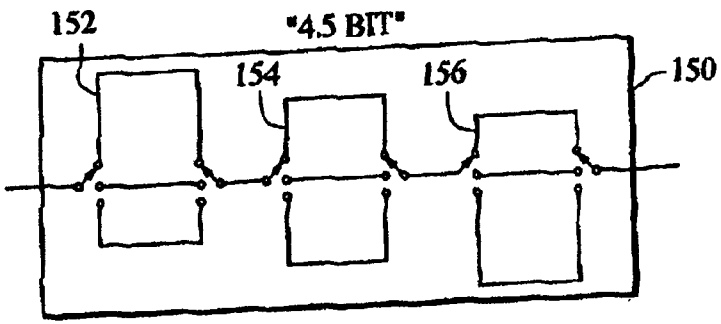
FIGS. 6A and 6B are respective schematic diagrams of "3.5" bit and "4.5" bit phase shifter circuits in accordance with an aspect of the invention.
Figure 6A:
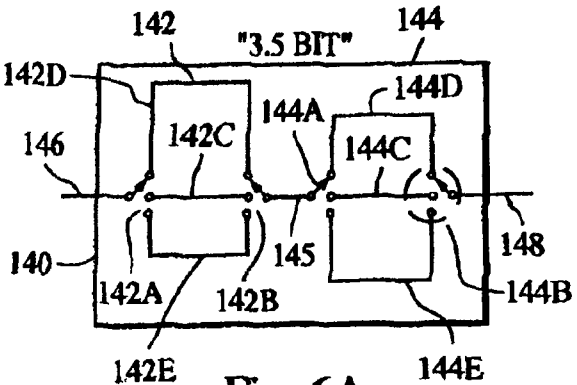

FIG. 6B shows a "4.5" bit phase shifter 150 using SP3T switch circuits. This circuit has three sections 152, 154, 156, instead of two sections as in the circuit 140. Each section has two SP3T MEM switches to select a reference path, a first phase shift path or a second phase shift path. The sections are connected in series.

As shown in Table 1, the "4.5" bit phase shifter 150 has 27 phase shift states while the basic 4-bit phase shifter (FIG. 5) has 16 phase shift states. Moreover, the "4.5" bit phase shifter 150 uses only three sections while the basic 4-bit phase shifter uses four sections. Thus the "4.5" bit phase shifter 150 (FIG. 6B) will have less RF loss than the basic 4-bit phase shifter (FIG. 5) and will offer more phase shift states than the basic 4-bit phase shifter. When the "4.5" bit phase shifter is installed into the MEMS ESA architecture (FIG. 1), the ESA will have more fixed beam positions without sacrificing gain.

TABLE 1

| Phase States | "3.5"-Bits | 4-Bits | "4.5"-Bits |
|---|---|---|---|
| 1 | 0 | 0 | 0 |
| 2 | 40 | 22.5 | 13.3333333 |
| 3 | 80 | 45 | 26.6666667 |
| 4 | 120 | 67.5 | 40 |
| 5 | 160 | 90 | 53.3333333 |
| 6 | 200 | 112.5 | 66.6666667 |
| 7 | 240 | 135 | 80 |
| 8 | 280 | 157.5 | 93.3333333 |
| 9 | 320 | 180 | 106.666667 |
| 10 | | 202.5 | 120 |
| 11 | | 225 | 133.333333 |
| 12 | | 247.5 | 146.666667 |
| 13 | | 270 | 160 |
| 14 | | 292.5 | 173.333333 |
| 15 | | 315 | 186.666667 |
| 16 | | 337.5 | 200 |
| 17 | | | 213.333333 |
| 18 | | | 226.666667 |
| 19 | | | 240 |
| 20 | | | 253.333333 |
| 21 | | | 266.666667 |
| 22 | | | 280 |
| 23 | | | 293.333333 |
| 24 | | | 306.666667 |
| 25 | | | 320 |
| 26 | | | 333.333333 |
| 27 | | | 346.666667 |

The high isolation provided by the RF MEMS switches allow the transmission lines in a switched line phase shifter to be compacted closer together without penalty of RF performance degradation. The reference path of the basic switched phase shifter section shown in FIG. 4A includes two SPST switches and a length of transmission line. By compacting the footprint of each phase shifter section, the reference path in each section can be reduced to a single RF MEMS switch as shown in the equivalent circuit diagram of an exemplary 180 degree phase shifter 170 in FIG. 7. Further compaction would reduce the discrete MEMS switch combination into an integrated MMIC as shown in FIGS. 8A–8C.

Figure 7:
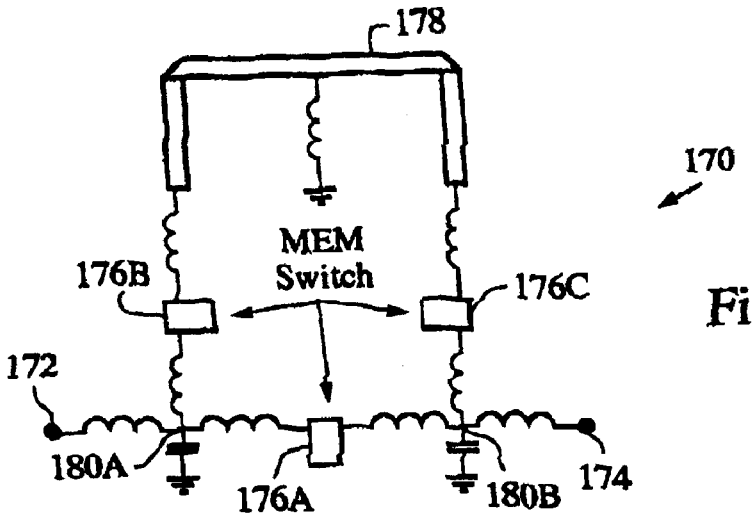
FIG. 7 is an equivalent circuit diagram of an exemplary 180 degree phase shifter.
Figure 8A:
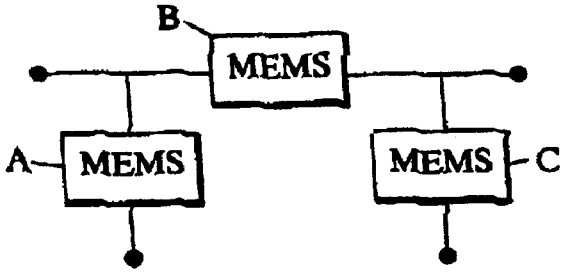
FIGS. 8A–8C are schematic illustrations of three connections of SP2T MEM switches to realize multiple throw switching circuits.
Figure 8B:
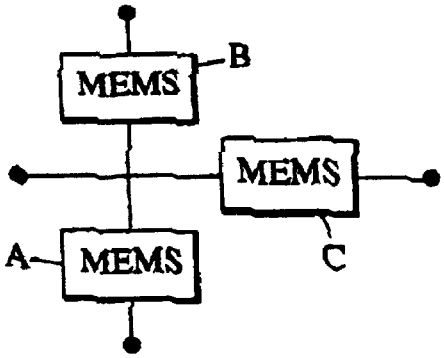
Figure 8C:
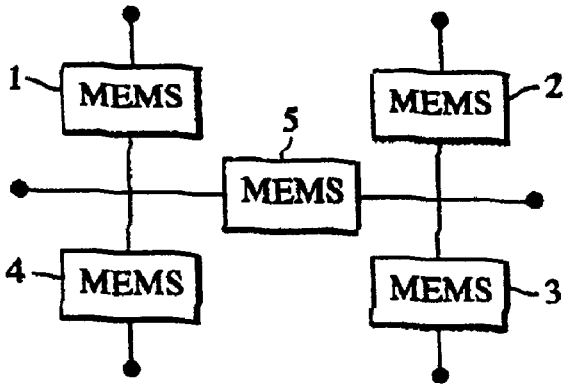

The phase shifter 170 illustrated in FIG.7 includes three SPST MEM switches 176A–176C. The RF ports 172, 174 are connected to the switch 176A by wire bond connections illustrated as inductances in FIG. 7. The switch 176A forms the reference path for the phase shifter 170. A 180° phase shift path 178 is selectively coupled to the RF ports 172, 174 by MEM switches 176B, 176C. In an exemplary embodiment, the circuit is fabricated on an alumina substrate, and path 178 is formed by a microstrip line on the substrate. Wire bond connections represented by inductances connect the switches 176B, 176C to nodes 180A, 180B. The values of the capacitances and the inductances (wire bond lengths) are designed to match the common junction impedances in a manner well known in the art.

The low capacitance of the metal-metal contact switches in the open state results in low parasitics at the switch junctions, as well as high isolation. Low parasitics make it possible for multiple metal-metal contact switches to share a common junction in parallel, i.e., the low parasitics enable the realization of MEM single-pole multi-thrown switch junctions. These "junctions" can be realized in hybrid circuits or integrated as a single MMIC chip.

FIGS. 8A–8I illustrate various new arrangements of MEM RF switches, e.g. metal-metal contact RP MEMS series switches. While the basic MEMS switch is a SPST device, these switch arrangements provide aspects of the invention, and can be employed not only in phase shifters, but in other applications including switchable attenuators, switchable filter banks, switchable time delay lines, switch matrices and transmit/receive RF switches. These arrangements can be realized as discrete MEMS devices in a hybrid microwave integrated circuit (MIC) or as a single monolithic microwave integrated circuit (MMIC) device.

FIGS. 8A–8C illustrates the "single-pole 2-throw" ("SP2T") junction and "single-pole 3-throw" ("SP3T") junctions as MMIC chips. The DC control lines for the switch junctions pass through vias. FIG. 8A shows an arrangement of MEMS devices A, B and C, as used for a switched line phase shifter, described below with respect to FIG. 9. FIG. 8B shows an arrangement of MEMS devices A, B and C, as used for a multi-bit reflection phase shifter described below with respect to FIGS. 13 and 19. FIG. 8C shows an arrangement of MEMS devices (1–5) as used for a multi-bit switched line phase shifter described more fully below with respect to FIG. 10.

Figure 8D:
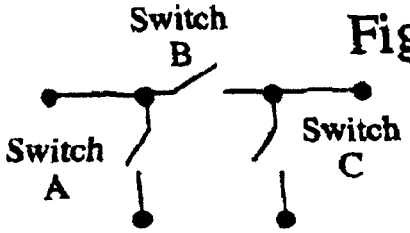
FIGS. 8D–8I are simplified schematic diagrams illustrating operation of the switch arrangements of FIGS. 3A–8C.
Figure 8E:
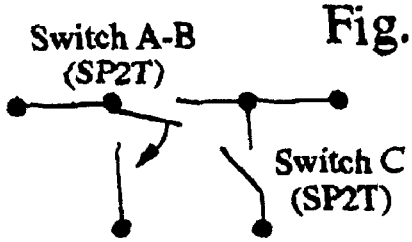

FIG. 8D shows the equivalent circuit for the switch arrangement of FIG. 8A, including three SPST switches A, B and C, which is capable of eight switch positions. Table 2 show the switch positions used to create the two phase states in the switched line phase shifter of FIG. 9. An alternative equivalent circuit is shown in FIG. 8E, which provides the same switch positions as a combination of a SP2T switch A–B and a SPST switch C.

TABLE 2

| State | Switch A | Switch B | Switch C |
|---|---|---|---|
| 1 | OPEN | CLOSE | OPEN |
| 2 | CLOSE | OPEN | CLOSE |

Figure 8F:
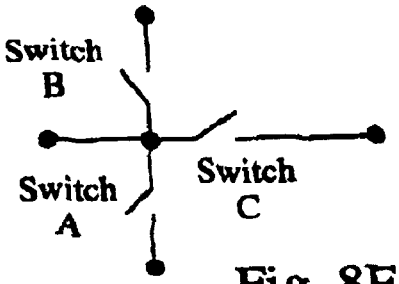

FIG. 8F shows an equivalent circuit for the switch arrangement of FIG. 8B, including three SPST switches A, B, C, which together are capable of eight switch positions as shown in Table 3. Table 3 show the switch positions (associated with the combination of three SPST switches) used to create the eight phase states in the multi-bit reflection phase shifter circuit 400 of FIG. 19.

TABLE 3

| State | Switch A | Switch B | Switch C |
|---|---|---|---|
| 1 | OPEN | OPEN | OPEN |
| 2 | OPEN | OPEN | CLOSE |
| 3 | OPEN | CLOSE | OPEN |
| 4 | OPEN | CLOSE | CLOSE |

TABLE 3-continued

| State | Switch A | Switch B | Switch C |
|---|---|---|---|
| 5 | CLOSE | OPEN | OPEN |
| 6 | CLOSE | OPEN | CLOSE |
| 7 | CLOSE | CLOSE | OPEN |
| 8 | CLOSE | CLOSE | CLOSE |

Figure 8G:
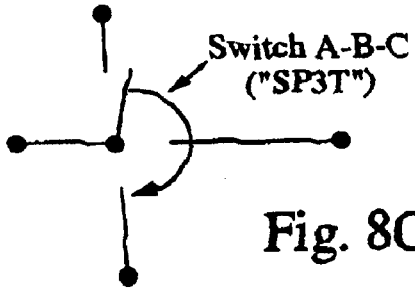

A subset of the switch positions in Table 3 is shown in Table 4. The switch positions in Table 4 can be used to create the four phase states in the multi-bit reflection phase shifter circuit 250 of FIG. 13. While using the same MEMS arrangement in FIG. 8B and switch positions in Table 4, the equivalent circuit in FIG. 8D reduce to that of a "SP3T" as illustrated in FIG. 8G. (Note the "SP3T" switch described in Table 4 is really a SP4T with one of the output ports terminated to an open circuit.)

TABLE 4

| State | Switch A | Switch B | Switch C |
|---|---|---|---|
| 1' | OPEN | OPEN | OPEN |
| 2' | OPEN | OPEN | CLOSE |
| 3' | OPEN | CLOSE | OPEN |
| 4' | CLOSE | OPEN | OPEN |

Figure 8H:
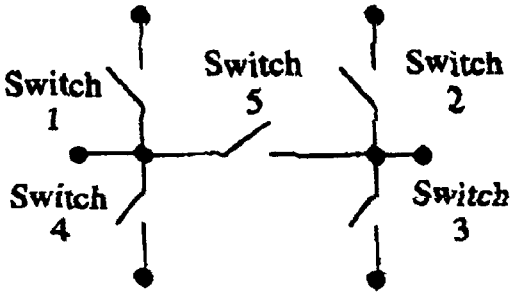
Figure 8I:
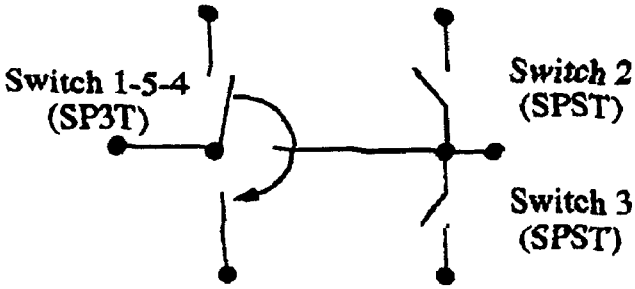

FIG. 8H shows an equivalent circuit for the switch arrangement of FIG. 8C, including five SPST switches (1–5) which together are capable of 120 switch positions. Table 5 show the switch positions used to create the three phase states in the switched line phase shifter of FIG. 10. Note the switch positions are the same as a combination of SP3T and SPST switches shown in FIG. 8I.

TABLE 5

| State | Switch 1 | Switch 2 | Switch 3 | Switch 4 | Switch 5 |
|---|---|---|---|---|---|
| 1 | OPEN | OPEN | OPEN | OPEN | OPEN |
| 2 | OPEN | OPEN | CLOSE | CLOSE | OPEN |
| 3 | CLOSE | CLOSE | OPEN | OPEN | OPEN |

Figure 19:
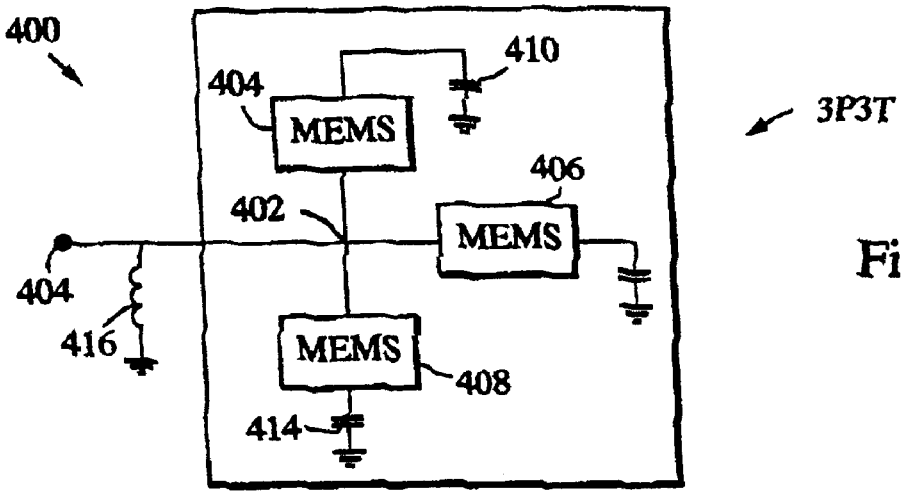
FIG. 19 shows an exemplary MEM switch reactive termination circuit.

Table 6 shows the MEM switch positions and their respective phase shifts for the 5-Bit phase shifter network (FIG. 22) including circuits 250 (FIG. 13) and 400 (FIG. 19). In this table, the MEMS switch is identified by their associated phase shift. The open switch position is designated by "0" while the closed switch is designated by "1". Note that multiple switches are closed for some phase state indicating that their associated termination are being added in parallel. The switch positions associated with circuit 250 is indicative of a SP3T switch while the switch positions are associated with circuit 400 is indicative of a 3P3T switch.

TABLE 6

| MEMS Switch Position | | | | | | | Phase | Phase |
|---|---|---|---|---|---|---|---|---|
| 270 | 180 | 90 | 45 | 22.5 | 11.3 | Bit | Shift | State |
| 0 | 0 | 0 | 0 | 0 | 0 | 00000 | 0 | 1 |
| 0 | 0 | 0 | 0 | 0 | 1 | 00001 | 11.25 | 2 |
| 0 | 0 | 0 | 0 | 1 | 0 | 00010 | 22.5 | 3 |
| 0 | 0 | 0 | 0 | 1 | 1 | 00011 | 33.75 | 4 |

TABLE 6-continued

| MEMS Switch Position | | | | | | | Phase | Phase |
|---|---|---|---|---|---|---|---|---|
| 270 | 180 | 90 | 45 | 22.5 | 11.3 | Bit | Shift | State |
| 0 | 0 | 0 | 1 | 0 | 0 | 00100 | 45 | 5 |
| 0 | 0 | 0 | 1 | 0 | 1 | 00101 | 56.25 | 6 |
| 0 | 0 | 0 | 1 | 1 | 0 | 00110 | 67.5 | 7 |
| 0 | 0 | 0 | 1 | 1 | 1 | 00111 | 78.75 | 8 |
| 0 | 0 | 1 | 0 | 0 | 0 | 01000 | 90 | 9 |
| 0 | 0 | 1 | 0 | 0 | 1 | 01001 | 101.25 | 10 |
| 0 | 0 | 1 | 0 | 1 | 0 | 01010 | 112.5 | 11 |
| 0 | 0 | 1 | 0 | 1 | 1 | 01011 | 123.75 | 12 |
| 0 | 0 | 1 | 1 | 0 | 0 | 01100 | 135 | 13 |
| 0 | 0 | 1 | 1 | 0 | 1 | 01101 | 146.25 | 14 |
| 0 | 0 | 1 | 1 | 1 | 0 | 01110 | 157.5 | 15 |
| 0 | 0 | 1 | 1 | 1 | 1 | 01111 | 168.75 | 16 |
| 0 | 1 | 0 | 0 | 0 | 0 | 10000 | 180 | 17 |
| 0 | 1 | 0 | 0 | 0 | 1 | 10001 | 191.25 | 18 |
| 0 | 1 | 0 | 0 | 1 | 0 | 10010 | 202.5 | 19 |
| 0 | 1 | 0 | 0 | 1 | 1 | 10011 | 213.75 | 20 |
| 0 | 1 | 0 | 1 | 0 | 0 | 10100 | 225 | 21 |
| 0 | 1 | 0 | 1 | 0 | 1 | 10101 | 236.25 | 22 |
| 0 | 1 | 0 | 1 | 1 | 0 | 10110 | 247.5 | 23 |
| 0 | 1 | 0 | 1 | 1 | 1 | 10111 | 258.75 | 24 |
| 1 | 0 | 0 | 0 | 0 | 0 | 11000 | 270 | 25 |
| 1 | 0 | 0 | 0 | 0 | 1 | 11001 | 281.25 | 26 |
| 1 | 0 | 0 | 0 | 1 | 0 | 11010 | 292.5 | 27 |
| 1 | 0 | 0 | 0 | 1 | 1 | 11011 | 303.75 | 28 |
| 1 | 0 | 0 | 1 | 0 | 0 | 11100 | 315 | 29 |
| 1 | 0 | 0 | 1 | 0 | 1 | 11101 | 326.25 | 30 |
| 1 | 0 | 0 | 1 | 1 | 0 | 11110 | 337.5 | 31 |
| 1 | 0 | 0 | 1 | 1 | 1 | 11111 | 348.75 | 32 |

It is an important feature that two or more MEMS can be combined at a single junction to form single-pole-multi-throw (SPMT) or multi-pole-multi-throw (MPMT) switch circuits, as illustrated in FIGS. 8A–8I. This feature is facilitated by the fact that the DC control signals are isolated from the RF signal path through the MEMS.

Figure 9:
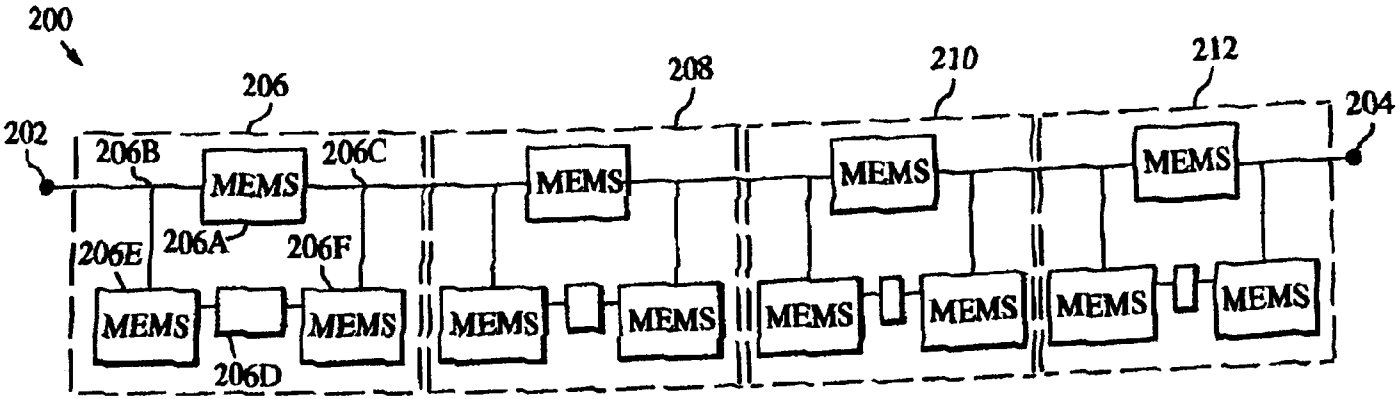
FIG. 9 is a simplified schematic diagram of an alternate 4-bit RF MEMS switched line phase shifter in accordance with another aspect of the invention, where the reference path in each section is replaced by a single switch.
Figure 10:
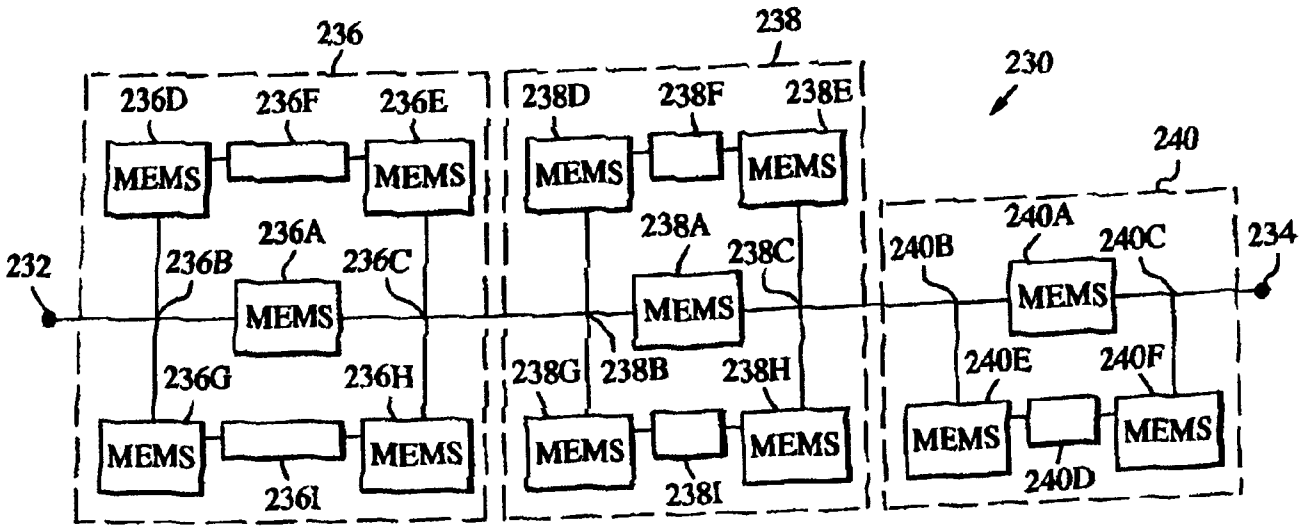
FIG. 10 illustrates a phase shifter circuit in three sections, with SP3T junctions creating an additional transmission line path in each phase shifter section.

Applying this innovation to the basic 4-bit RF MEMS switched line phase shifter in FIG. 5 results in realization of the alternate embodiment of FIG. 9, where the reference path in each section is replaced by a single switch. The 4-bit circuit 200 of FIG. 9 has less RF loss and uses fewer switches than the 4-bit phase shift circuit of FIG. 5.

The phase shifter 200 has RF ports 202, 204, and four sections 206, 208, 210, 212. Each section is identical except the electrical length of the respective phase shift path. Thus, section 206 includes SPST MEM switch 206A connected between the section RF terminals 206B, 206C, to provide the reference path. The phase shift path 206D is provided by a transmission line segment, e.g. microstrip, which is selected by SPST MEM switches 206E, 206F. The SPST switches 206A and 206E form a SP2T switch circuit. The phase shift paths for the different sections have different electrical lengths to provide the desired phase shifts for the particular sections. For the case of microstrip phase shift paths, the microstrip lines can be fabricated off-chip, with the MEMS in each section fabricated on a single chip or substrate, or alternatively on separate chips or substrates. The four sections are connected in series, to provide a 4-bit phase shifter having 16 phase states.

Further advancement is achieved when the SP2T junction switches used in the circuit of FIG. 9 are replaced with SP3T junctions to create an additional transmission line path in each phase shifter section. The resulting phase shifter circuit 230 shown in FIG. 10 has 18 phase states using 13 switches in three sections, while the 4-bit circuit in FIG. 9 has 16 phase states using 12 SPST switches. The basic 4-bit RF MEMS switched line phase shifter in FIG. 5 has 16 phase states using 16 SPST switches. Thus, metal-metal contact series switches enable single-pole multi-throw junctions, which in turn make it possible to realize phase shifters with fewer switches, and hence lower insertion loss and reduced cost.

The phase shifter 230 includes RF ports 232 and 234, connected by the three phase shift sections 236, 238 and 240. Section 236 includes a first SPST MEM switch 236A which is connected between the section RF terminals 236B, 236C to provide the reference path. This section has two phase shift paths 236F, 236I, provided by respective transmission lines, of respective electrical lengths 120° and 240°. The 240° path 236F is selected by SPST MEM switches 236D, 236E. The 120° path 236I is selected by SPST MEM switches 236G, 236H. The three SPST MEMS 236A, 236D, 236G form a SP3T switch circuit.

Section 238 has three states as well, 0°, 40° and 80°. The reference path (0°) is provided by SPST MEM switch which connects the section RF terminals 238B, 238C. This section has two phase shift paths 238F, 238I, provided by respective transmission lines, of respective electrical lengths 40° and 80°. The 40° path 236F is selected by SPST MEM switches 238D, 238E. The 80° path 238I is selected by SPST MEM switches 238G, 238H.

The section 240 has two states, 0° and 20°. The reference (0°) path is provided by SPST MEM switch connecting the section RF terminals 240B, 240C. The 20° phase shift path 240D is provided by a transmission line selectively switched by SPST switches 240E, 240F.

Figure 11:
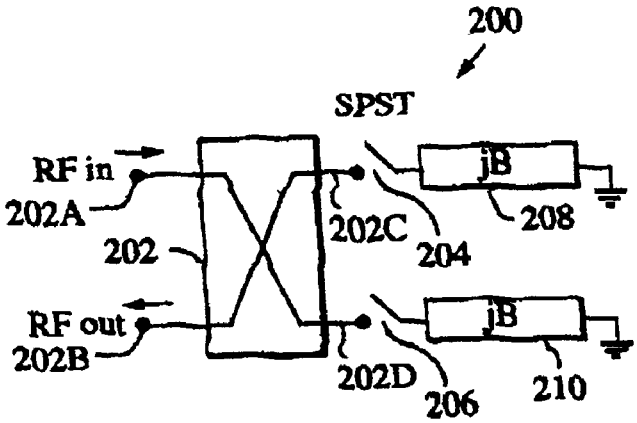
FIG. 11 is a schematic diagram of a reflection phase shift circuit generating phase shifts by switching in different reactances that terminate the in-phase and quadrature ports of a 3 dB quadrature hybrid coupler

Another aspect of the invention is a new class of reflection phase shifter configurations that employs metal-metal RF MEMS switches. FIG. 11 is a schematic diagram of a reflection phase shift circuit 200. Like conventional PIN diode and FET reflection phase shifters, the circuit generates phase shifts by switching in different reactances that terminate the in-phase and quadrature ports 202C, 202D of a 3 dB quadrature hybrid coupler 202. Each of reactant terminations 208, 210 generates a complex reflection coefficient close to unity in magnitude but with different phase angles. The reactances can be fabricated with inductances, capacitances, inductances and capacitances, or by transmission line segments. In this embodiment, the reactances 208, 210 are equal reactances, and the switches 204 and 206 are operated in tandem, both open or both closed, to provide symmetrical operation. The RF input is at port 202A; the phase shifter RF output is at port 202B. The switches 204, 206 are RF MEM switches, as illustrated in FIGS. 2 and 3. The phase shift is given by:

$$\Delta\Phi_n = -2[\tan^1(B)\delta_{1n}]$$

where n=0, 1, δ=Kronecker delta function=1 (switch open), 0 (switch closed).

Unlike PIN diode and FET switches, DC bias used to actuate the metal-metal RF MEMS switches is not coupled to the RF transmission line. This embodiment of a reflection phase shifter has only two phase states (one-bit) per unit cell or section; this is also the case of a conventional reflection phase shifter using PIN diode or FET switches.

In reflection phase shifter configurations, the MEM switches are able to combine the termination reactances in parallel. Thus the functionality of a 3-bit phase shifter (including three sections) can be combined in a single section. These new circuits occupy the same foot print as a conventional single bit phase shifter circuits but have increased capability to generate twice or more the number of phase shift bits than the convention designs with less RF loss across a wide band width.

The use of a new single pole multi-throw junction in a reflection phase shifter thus provides another new reflection phase shifter configuration. This is realizable because of the RF characteristics exhibited by the metal-metal contact RF MEMS switch. By using a single phase shifter "section" or unit cell, multiple phase states can be realized by switching in the different reactances that terminate the coupler. The use of diode (PIN or varactor) and FET switch is not appropriate for this configuration because of the higher RF losses associated with these devices and because of the performance limitation due to the required bias circuitry along the RF path.

Figure 12:
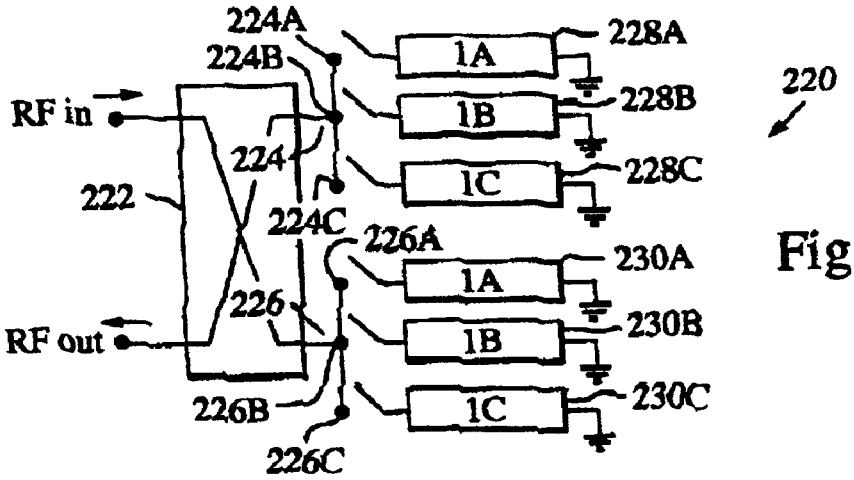
FIG. 12 is a schematic diagram illustrating use of SP3T MEM switch circuits to realize a "multi-bit" reflection phase shifter section.

FIG. 12 is a schematic diagram illustrating use of SP3T MEM switch circuits to realize a "multi-bit reflection phase shifter section". In this embodiment, the SPST switches of the embodiment of FIG. 11 are replaced with SP3T MEM switch circuits 224, 226, each fabricated by use of three SPST switches as illustrated in FIG. 8B. The SP3T circuits can be fabricated by bonding three SPST MEM switch chips to a common junction, or by combining three SPST MEM switches with a common junction on a single substrate or chip. The respective ports 224A, 224B, 224C are coupled to corresponding normalized reactances 228A, 228B, 228C, to provide a means to select the termination reactance. The phase shift $\Delta\Phi_{xyz}$ provided by the circuit 220 is given by:

$$\Delta\Phi_{xyz}=-2[\tan^{-1}(A)*x+\tan^{-1}(B)*y+\tan^{-1}(C)*z]$$

where x=1 when port 224A is open, and=0 when closed; y=1 when port 224B is open and=0 when closed; z =1 when port 224C is open and=0 when closed. The switches 224 and 226 are operated in tandem, so that reactances 228A and 230A are selected together, or reactances 228A, 230C are selected together, or reactances 228C, 230C are selected together, or both switches are open.

Figure 13:
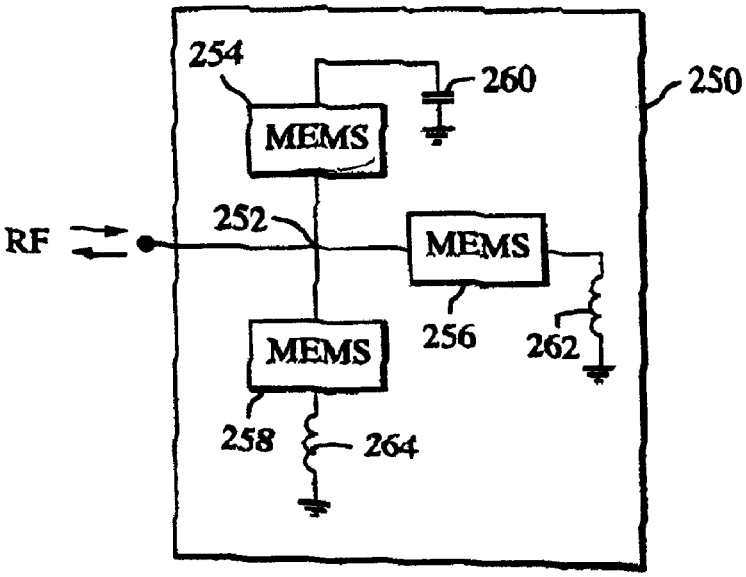
FIG. 13 is a schematic diagram showing RF MEMS to implement a SP3T junction providing a phase shifter termination section for the terminations for the reflection phase shifter of FIG. 12.

The approach of using RF MEMS to implement a SP3T junction is applied to provide a phase shifter termination section 250, illustrated in FIG. 13, providing the 0°, 90°, 180°, and 270° phase states for the terminations for the reflection phase shifter 220 of FIG. 12. The circuit 250 can be fabricated as a monolithic or hybrid device, and comprises an RF port 252 to which the SPST MEM switches 254, 256, 258 are connected. The MEM switch 254 couples the node 252 to capacitor 260 and ground. The MEM switch 256 couples the node 252 to inductor 262 and ground. The MEM switch 258 couples the node 252 to inductor 264 and ground.

In operation, all MEM switches 254, 256, 258 are open to provide the reference phase (0°). For 90°, MEMS 254 is closed, and MEMS.256, 258 are open. For 180°, MEMS 256 is closed, and MEMS 254 and 258 are open. For 270°, MEMS 258 is closed, and MEMS 254 and 256 are closed. The reactance values for capacitor 260 and inductors 262 and 264 are selected to provide the respective desired phase shifts.

In an exemplary embodiment, the phase shifter section 250 can be fabricated to operate across the wide 8 GHz to 12 GHz frequency band.

Figure 14:
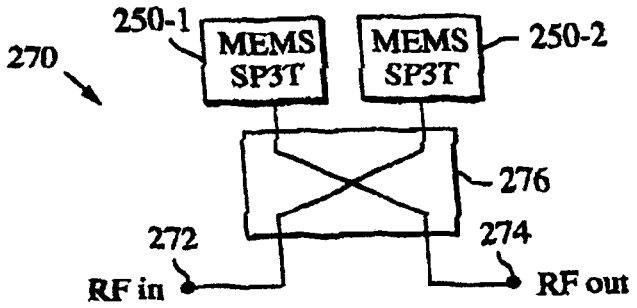
FIG. 14 illustrates a single section, 2-bit reflection phase shifter employing SP3T MEM switch circuits as shown in FIG. 13.

FIG. 14 illustrates a single section, 2-bit reflection phase shifter 270 employing SP3T MEM switch circuits as shown in FIG. 13. The phase shifter has RF ports 272, 274, at the RF ports of the 3 dB hybrid coupler 276. The SP3T MEM switch circuits 250-1 and 250-2 are connected at the in-phase and quadrature ports of the coupler 256:. In this embodiment, the reactance terminations are integrated into the MEM switch circuits. The four phase states are provided by operating the MEMS 250-1, 250-2 in tandem, to select symmetrical reactances in the respective MEMS. Thus, the reference phase state is provided with all MEMS are open, and the three phase shift states are provided by closing corresponding ones of the SPST MEM switches which together comprise the respective SP3T switch circuits 250-1, 250-2.

Figure 15:
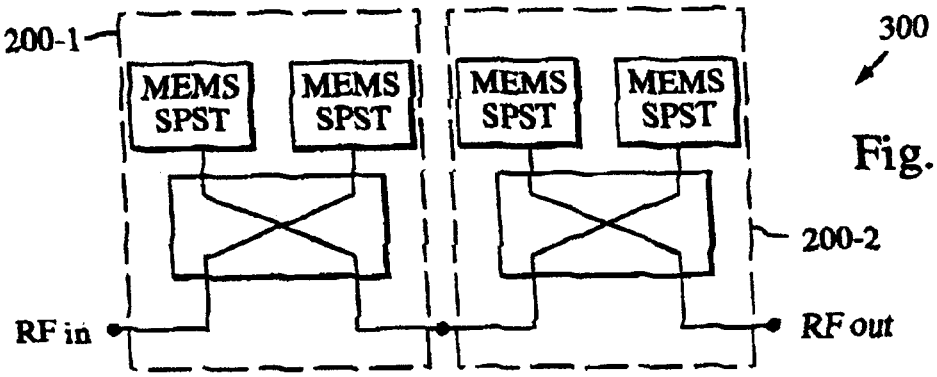
FIG. 15 shows an alternate 2-bit reflection phase shifter circuit employing SPST MEM switches with integrated reactance terminations.

FIG. 15 shows an alternate 2-bit reflection phase shifter circuit 300 employing SPST MEM switches with integrated reactance terminations. This configuration employs two single bit sections 200-1 and 200-2 connected in series. The sections 200-1 and 200-2 are of the type illustrated in FIG. 11.

Figure 16:
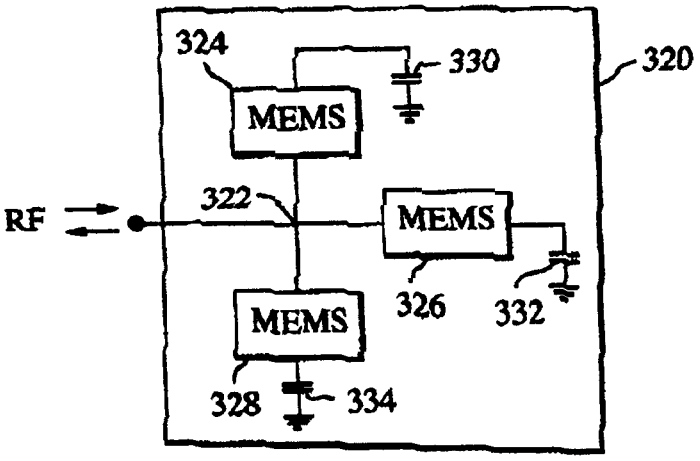
FIG. 16 is a simplified schematic diagram of a phase shifter section realizing 0°, 22.5°, 45°, and 67.5° phase states.

A phase shifter section 320 designed to realize the 0°, 22.5°, 45°, and 67.5° phase states is shown in FIG. 16. This phase shifter section can be fabricated to operate across a wide 8 GHz to 12 GHz frequency band. The circuit 320 can be fabricated as a monolithic or hybrid device, comprising an RF port 322 to which the SPST MEM switches 330, 332, 334 are connected. The MEM switch 324 couples the node 322 to capacitor 330 and ground. The MEM switch 326 couples the node 322 to inductor 332 and ground. The MEM switch 328 couples the node 322 to inductor 334 and w ground. This phase shifter section is operated in a similar manner to that described with respect to circuit 250 of FIG. 13; however, the reactance values will be selected to provide the 22.5°, 45°, and 67.5° phase states.

Figure 17:
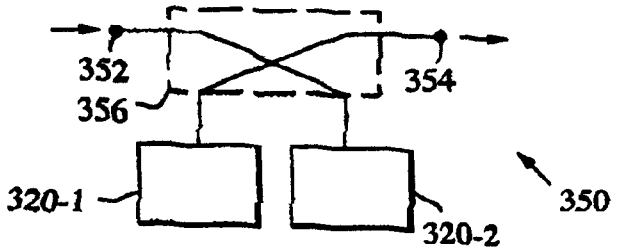
FIG. 17 illustrates a reflection phase shifter employing the 2-bit reflection phase shift termination circuits of the type illustrated in FIG. 16.

FIG. 17 illustrates a reflection phase shifter 350 employing the 2-bit reflection phase shift termination circuits of the type illustrated in FIG. 16 as circuit 320. The phase shifter 350 has RF ports 352, 354 and a quadrature coupler 356. The 2-bit reflection devices 320-1 and 320-2 are connected to the in-phase and quadrature sidearm ports of the coupler 356. The SP3T switch circuits 320-1 and 320-2 are operated in tandem, employing corresponding reactance values for the terminations to provide balanced operation.

Figure 18:
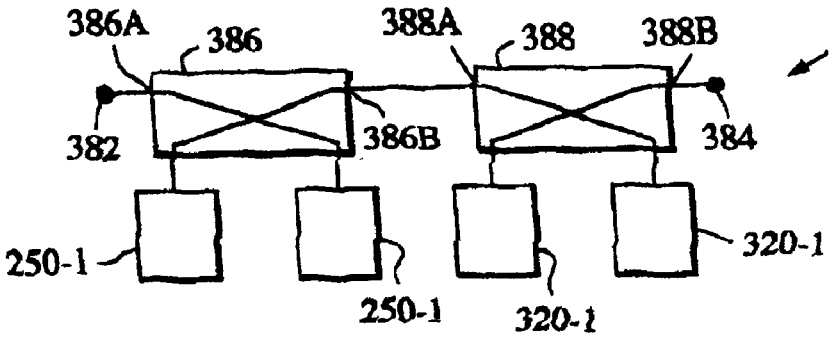
FIG. 18 is a schematic diagram of a 4-bit phase shifter with 16 phase states, using the two phase shifter sections of FIGS. 14 and 17.

The two phase shifter sections of FIGS. 14 and 17 combine to form the equivalent of a 4-bit phase shifter with 16 phase states (FIG. 18). Thus, phase shift circuit 380 has RF ports 382 and 384. Two quadrature hybrid. couplers 386, 388 are connected in series, with RF output port 386B of coupler 386 coupled to RF input port 388A of coupler 388. SP3T MEM switch circuits 250-1 and 250-2 with integrated reactive terminations (as shown in FIG. 13) are connected to the in-phase and quadrature sidearm ports of the coupler 386. With the first section (including coupler 386) providing phase shift states of 0°, 90°, 180° and 270°, and with the second section (including coupler 388) providing phase shift states of 0°, 22.5°, 45° and 67.5°, the phase shifter 380 can provide 16 phase shift states.

The phase shifter sections described above with respect to FIGS. 14 and 17 actuates the SPST MEM switches within each SP3T junction one at a time. Further advances can be achieved when multiple switches are actuated simultaneously and their corresponding reactant terminations are added together in parallel. The new impedances resulting from these parallel combinations of reactances realize additional phase states. Again this is possible because of the high isolation and low RF loss generated by the metal-metal contact RF MEMS switches.

Figure 20:
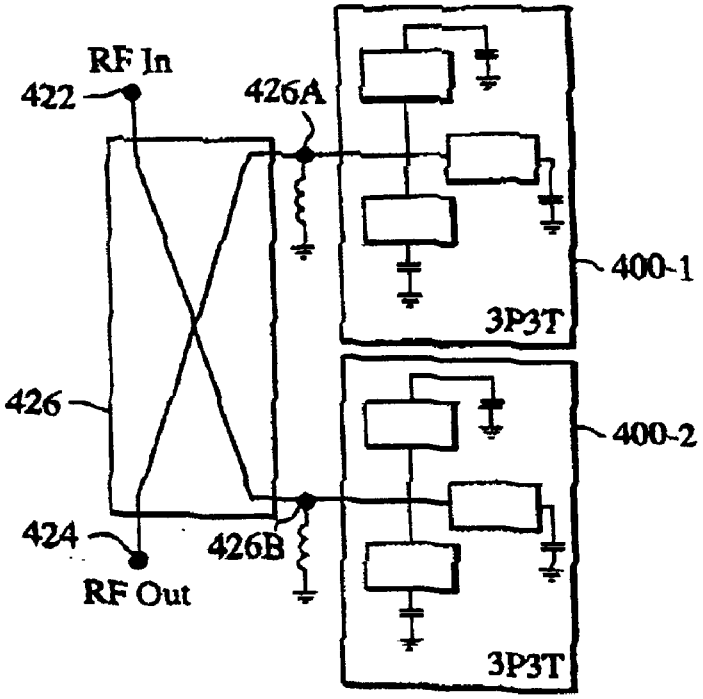
FIG. 20 is a schematic diagram of a reflection-type 3-bit phase shifter.

FIGS. 19 and 20 illustrates a circuit designed to create phase states using the parallel combination of the baseline terminations when actuating multiple switches simultaneously. FIG. 20 is a schematic diagram of a reflection-type 3-bit phase shifter 420, having RF ports 422 and 424, and a hybrid 3 dB coupler 426 having in-phase and quadrature ports 426A, 426B. Respective MEM switch reactive termination circuits 400-1 and 400-2 with a 3P3T junction are used to terminate the coupler ports 426A, 426B.

FIG. 19 shows an exemplary MEM switch reactive termination circuit 400 as used in the circuit of FIG. 20. It is possible to realize as many as eight phase states from a junction 402 with three SPST MEM switches 404, 406, 408 respectively connecting to reactances 410, 412, 414, to realize a 3-bit phase shifter. This single section 3-bit phase shifter circuit equates the phase shift performance of three conventional single bit phase shifter sections using 6 individual PIN diode switch devices. The circuit 420 employs identical circuits 400-1 and 400-2 in a balanced configuration.

Figure 21:
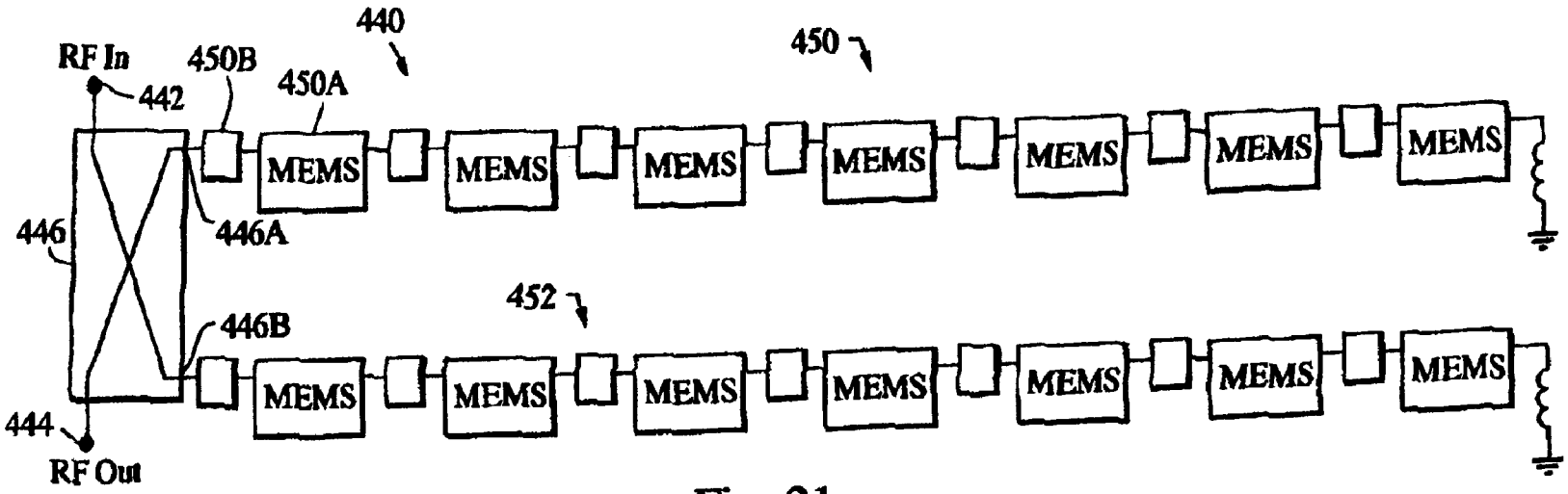
FIG. 21 illustrates a single section 3-bit phase shifter realized by a single phase section with 16 individual switch devices tied together in series.
Figure 22:
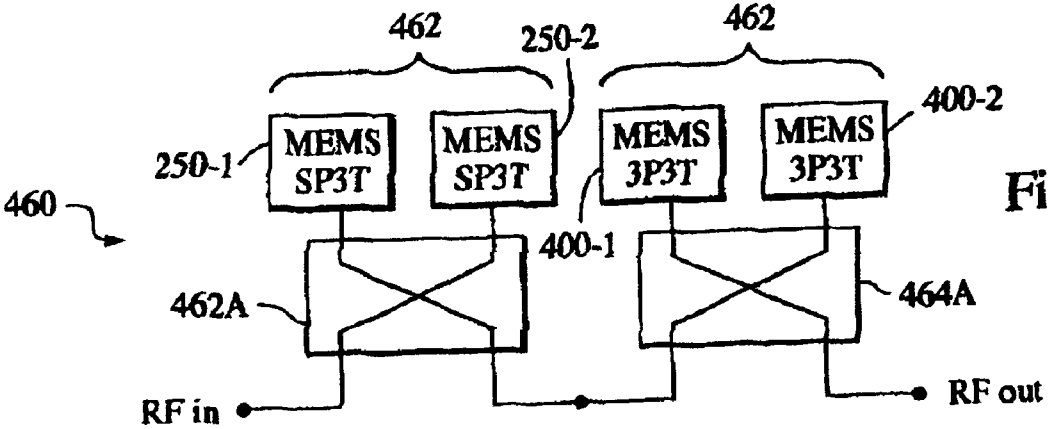
FIG. 22 is a schematic diagram of a 5-bit phase shifter realized with two sections by using the circuits in FIG. 10 and 16.

A single section 3-bit phase shifter can also be realized by a single phase section with 16 individual switch devices tied together in series (FIG. 21). This is shown in FIG. 21, in which phase shifter 440 includes RF ports 442, 444, and a 3 dB hybrid coupler 446. The in-phase and quadrature ports 446A, 446B are terminated by respective series circuits 450, 452. Each series circuit including alternating series connected transmission line segments, e.g. segment 450B and MEM SPST switches, e.g. switch 450A. The phase shift then becomes the cumulative round trip time delay of the transmission line segments when they are switched together in series. The cumulative delay is selected by the appropriate control of the MEM switches to lengthen/shorten the round trip path length FIG. 22 is a schematic diagram of a 5-bit phase shifter 460 realized using two sections 462, 464 by using the circuits in FIG. 10 and 16. Thus, section 462 includes a hybrid 3 dB coupler with SP3T MEM switch reactance terminations 250-1 and 250-2 connected to the in-phase and quadrature ports. Section 464 is connected in series to section 462, and includes coupler 464A with 3P3T MEM switch reactance terminations 400-1 and 400-2. This new phase shifter uses four SP3T junctions and generates 32 phase states using only two sections. Thus, metal-metal contact series switches enable single-pole multi-throw junctions, which in turn make it possible to realize phase shifters with fewer switches, and hence lower insertion loss and reduced cost.

The phase shifter circuits in accordance with this invention have many advantages, including advantages resulting from the MEM switches. MEM RF switches do not require any DC biasing circuit along the RF path. A single MEM RF switch has better wide band RF performance than a comparable but more complex design using multiple PIN diodes and FET devices. A phase shifter circuit using MEM RF switches can then operate across a wider frequency band with lower RF loss, higher 3rd order intercept point and higher isolation than what has been achieved with current state of the art devices. This is done without sacrificing weight, cost or power consumption. Low cost manufacturing of MEMS is achieved using standard thin film fabrications processes and materials use in the commercial IC industry. Unlike conventional IC devices, MEMS RF switches can also be fabricated directly onto ceramic hybrid circuit and traditional printed circuit board assemblies to achieve even lower cost.

The use of MEMS RF switches results in the realization of phase shifter circuits that operate across a wider frequency band, with lower RF, higher 3rd order intercepts point and less DC power consumption than what is available in currently used state of the art devices (or circuits). The unique construction of the metal to metal contact MEMS RF switch allows it to operate as a series switch. Because DC actuation of metal-to-metal contact MEMS RF switches is decoupled from the RF path, these switches do not require any DC biasing circuits along the RF path. Thus, these series switches can be combined to form multi-pole, multi-throw switches (FIGS. 8A–BC) and can be used to realize multi-phase switched line phase shifter circuits. These circuits occupy the same foot print as a convention single bit phase shifter circuits but have increased capability to generate twice the number phase shift bits than the convention designs with less RF losses across a wide band width.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An RF reflection phase shifter circuit, comprising:

a coupler device having first and second RF I/O ports, and in-phase and quadrature ports;

a switch circuit comprising a plurality of single-pole-single-throw (SPST) micro-electro-mechanical ("MEM") switches responsive to control signals, said switch circuit arranged to select one of a plurality of discrete phase shift values introduced by the phase shifter circuit to RF signals passed between the first and second RF ports, said circuits connected to provide a single-pole-multiple-throw (SPMT) or multiple-pole-multiple-throw (MPMT) switch function;

said MEM switch circuit including first and second reactance switch circuits selectively coupling first and second termination reactance circuits respectively to the in-phase and quadrature ports, each said reactance circuit including a plurality of selectable reactance values connected in parallel which are selectable in parallel combinations to select different phase shift values.

2. The circuit of claim 1, wherein the respective plurality of selectable reactance values connected in parallel for the first and second termination reactance circuits define pairs of equal reactance values which are switched in tandem to provide symmetrical operation.

3. The circuit of claim 1, wherein said first and second MEM switch circuits provide MPMT switching functions.

4. The circuit of claim 1, wherein said MEM switches are metal-metal contact RF MEMS series switches.

5. A multi-section RF phase shifter circuit, comprising:

a plurality of reflection phase shift sections connected in series to provide a discrete set of selectable phase shifts to RF signals passed through the circuit, and wherein each reflection phase shift section includes:

a coupler device having first and second RF I/O ports, and in-phase and quadrature ports;

a switch circuit comprising a plurality of single-pole-single-throw (SPST) micro-electro-mechanical ("MEM") switches responsive to control signals, said switch circuit arranged to select one of a plurality of discrete phase shift values introduced by the phase shifter circuit to RF signals passed between the first and second RF ports;

said MEM switch circuit including first and second reactance switch circuits selectively coupling first and second termination reactance circuits respectively to the in-phase and quadrature ports, each said reactance circuit including a plurality of selectable reactance values connected in parallel which are selectable in parallel combinations to select different phase shift values.

6. The circuit of claim 5, wherein the respective plurality of selectable reactance values connected in parallel for the first and second termination reactance circuits define pairs of equal reactance values which are switched in tandem to provide symmetrical operation.

7. An electronically scanned array, comprising:

a linear array of radiating elements;

an array of reflection phase shifters coupled to the radiating elements;

an RF manifold including a plurality of phase shifter ports respectively coupled to a corresponding phase shifter RF port and an RF port; and a beam steering controller for providing phase shift control signals to the phase shifters to control the phase shift setting of the array of the phase shifters;

and wherein said phase shifters each include:

a plurality of micro-electro-mechanical ("MEM") switches responsive to said control signals to select one of a discrete number of phase shift settings for the respective phase shifter;

a coupler device having first and second RF I/O ports, and in-phase and quadrature ports, and first and second reactance circuits respectively coupled to the in-phase and quadrature ports by first and second MEM switch circuits, said first and second reactance circuits each comprising a plurality of susceptances connected in parallel for terminating said in-phase or quadrature port, and wherein said first and second MEM switch circuits select at least one of said plurality of susceptances connected in parallel for each of said first and second reactance circuits to select a phase shift setting, and wherein said plurality of susceptances can be selected in parallel combinations.

8. The array of claim 7, wherein said first and second MEM switch circuits each comprise first, second and third MEM switches each terminated respectively in a first, second or third one of said plurality of susceptances.

9. The array of claim 8, wherein said plurality of susceptances can be switched to provide at least eight different discrete phase settings.

10. The array of claim 7, wherein the respective plurality of susceptances comprising said first and second reactance circuits define pairs of equal susceptances which are switched in tandem to provide symmetrical operation.

11. The circuit of claim 7, wherein said first and second MEM switch circuits provide MPMT (multiple-pole-multiple-throw) switching functions.

12. The array of claim 7 wherein said MEM switches are single-pole-single-throw (SPST) switches including an armature for opening and closing the RF signal path through the switch, and a control signal path, and wherein the control signals are isolated from the RF signal path.

* * * * *